US006289679B1

(12) United States Patent
Tunkel et al.

(10) Patent No.: US 6,289,679 B1
(45) Date of Patent: Sep. 18, 2001

(54) NON-FREEZE ENHANCEMENT IN THE VORTEX TUBE

(75) Inventors: Lev Tunkel, Princeton, NJ (US); Boris Khasqvitski, Nesher (IL)

(73) Assignee: Universal Vortex, INC, Robbinsville, NJ (US)

( * ) Notice: Subject to any disclaimer, the term of this patent is extended or adjusted under 35 U.S.C. 154(b) by 0 days.

(21) Appl. No.: 09/614,580

(22) Filed: Jul. 12, 2000

Related U.S. Application Data

(60) Provisional application No. 60/143,530, filed on Jul. 13, 1999.

(51) Int. Cl.[7] ..... F25B 9/02
(52) U.S. Cl. ..... 62/5
(58) Field of Search ..... 62/5

(56) References Cited

U.S. PATENT DOCUMENTS

| | | | | |
|---|---|---|---|---|
| 2,920,457 | * | 1/1960 | Bartlett | 62/5 |
| 3,118,286 | * | 1/1964 | Schroeder | 62/5 |
| 3,942,330 | * | 3/1976 | Schroeder | 62/5 |
| 5,582,012 | * | 12/1996 | Tunkel et al. | 62/5 |
| 5,911,740 | * | 6/1999 | Tunkel et al. | 62/5 |

* cited by examiner

*Primary Examiner*—Ronald Capossela
(74) *Attorney, Agent, or Firm*—J. Harold Nissen

(57) ABSTRACT

This invention is concerned with a method for a non-freeze enhancement in a vortex tube assembly which includes a heat exchanger having an uncontrolled opening in its inner passage and a vortex tube comprising a slender tube, a diaphragm having a hole in the center thereof and closing one end of the vortex tube, one or more tangential nozzles piercing the slender tube just inside the diaphragm and an outlet opening on the other end of the vortex tube, the method comprises ways of connecting the non-freeze enhanced vortex tube as follows: attaching a heat exchanger to an outward side of a vortex tube's diaphragm; connecting a vortex tube's diaphragm hole for discharging a cold fraction flow with a heat exchanger's inlet opening and then connecting the inlet opening through a heat exchanger's inner passage with a heat exchanger's outlet opening to discharge gas flow from the non-freeze enhanced vortex tube assembly; and connecting a vortex tube outlet opening at the far end of the vortex tube with another heat exchanger's inlet opening, thus providing for the hot flow to flow over the surfaces on the inside of the heat exchanger and then leave or exit the heat exchanger through an uncontrolled opening in the heat exchanger's inner passage to mix with the cold fraction exiting the vortex tube. The invention is also concerned with a method for a non-freeze enhancement in a vortex tube arrangement which includes two heat exchanges and two vortex tubes.

6 Claims, 1 Drawing Sheet

NON-FREEZE ENHANCEMENT IN THE VORTEX TUBE

This application claims of Prov. No. 60/143,530 filed Jul. 13, 1999.

BACKGROUND OF THE INVENTION

1. Field of the invention

This invention is concerned with vortex tubes. More particularly, the present invention relates to a manufacture using a method of a vortex tube design, which provides a vortex tube having a high efficiency by eliminating of any freeze up during operation.

2. Description of the Prior Art

A vortex tube comprises a slender tube with a diaphragm closing one end of the tube provided with a discharge hole in the center of the diaphragm, one or more tangential inlet nozzles piercing the tube just inside of the diaphragm and, depends on the vortex tube's desirable performance, a controlled discharge opening (throttle valve) or plug (U.S. Pat. No. 5,911,740) on the other end of the slender tube.

In the vortex tube an inlet high-pressure gas flow undergoes energy separation forming two low-pressure currents: cold and hot. Under some circumstances a cold fraction discharged from the vortex tube through the diaphragm opening may freeze up and reduce the diaphragm orifice, thus causing the vortex tube's performance deterioration.

It is known to use a vortex tube's hot fraction to prevent discharge diaphragm freeze up. At this point a hot flow taken prior to or after the throttle valve is directed to the heat exchanger attached to the outward side of the diaphragm (U.S. Pat. No. 5,749,231) or, according to the U.S. Pat. No. 5,937,654, a hot flow circulates in the heat transfer body coinciding with outward of the vortex tube's cross section.

SUMMARY OF THE INVENTION

The present invention provides for non-freeze operation in a vortex tube by directing a hot flow through a heat exchanger attached to the outward side of the vortex tube's cross section and discharging this hot flow through an uncontrolled opening set up on the heat exchanger's inner pass which connects the diaphragm hole and the heat exchanger's outlet opening.

Thus, according to invention, a hot fraction flow not only heats up vortex tube's inlet cross section and diaphragm, but also warms vortex cold fraction in its discharge pass, which results in increasing the unit's performance reliability.

The best results with the present invention can be achieved when a vortex tube operates in the heat transfer enhancement mode (U.S. Pat. No. 5,911,740, U.S. Pat. No. 6,082,116), e.g. when the main objective of the vortex tube's performance is a heat transfer upstream of the diaphragm.

DETAILED DESCRIPTION OF THE PREFERRED EMBODIMENTS

Figure 1:
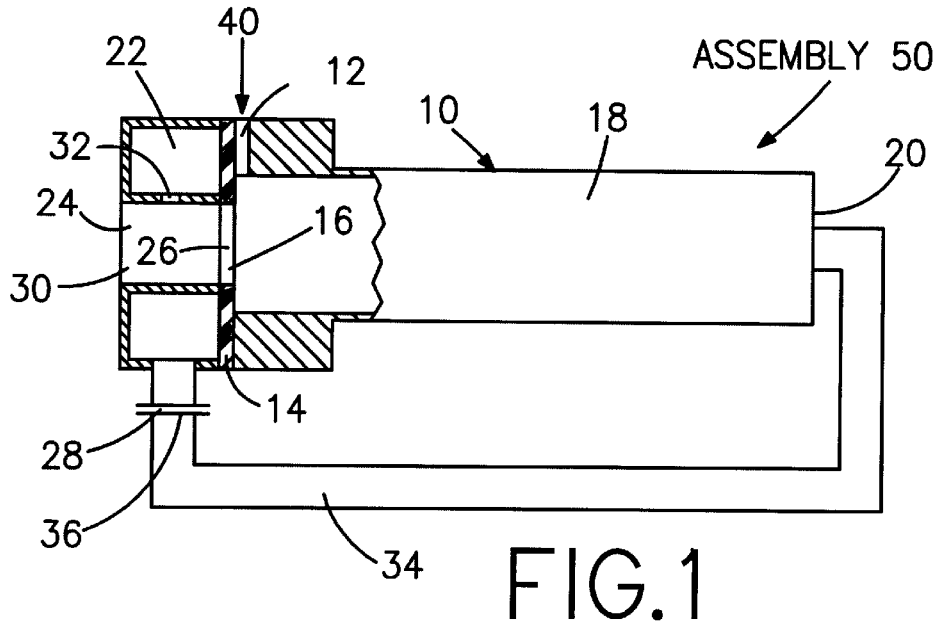
FIG. 1 is a schematic design and flow diagram of one embodiment of the invention.

The flow diagram in FIG. 1 illustrates one embodiment of the invention. A non-freeze vortex tube assembly 50 according to the invention includes a vortex tube 10 provided with the inlet nozzle 12, a diaphragm 14 provided with a central hole 16, a slender tube 18 with its outlet opening 20, and a heat exchanger 22 provided with an inner passage 24, two inlet openings 26 and 28, one outlet opening 30 and an uncontrolled opening 32 set up on the inner passage 24. Openings 26 and 30 also serve as inner passage's 24 inlet and outlet, respectively. A gas flow in the direction of arrow 40 enters assembly 50 through the vortex tube's nozzles 12 and then undergoes an energy (temperature) separation forming a cold and hot fraction. A cold fraction is discharged from the vortex tube 10 through diaphragm hole 16 and enters into a heat exchanger inlet opening 26, then goes through inner passage 24 in the heat exchanger and leaves or exits from the heat exchanger 22 through its outlet opening 30. A hot fraction passes through slender tube's 18 outlet opening 20 and is then directed through line 34 and its outlet 36 and enters into heat exchanger 22 through inlet opening 28 and goes toward the uncontrolled opening 32 simultaneously flowing over the surfaces on the inside of the heat exchanger and leaves or exits from the heat exchanger through uncontrolled opening 32, mixing up with the cold fraction exiting from the vortex tube. The uncontrolled opening is preferably located on such side of the passage 30 which is opposite to the heat exchanger inlet 28; the opening diameter is preferably less than vortex tube's diaphragm diameter.

Figure 2:
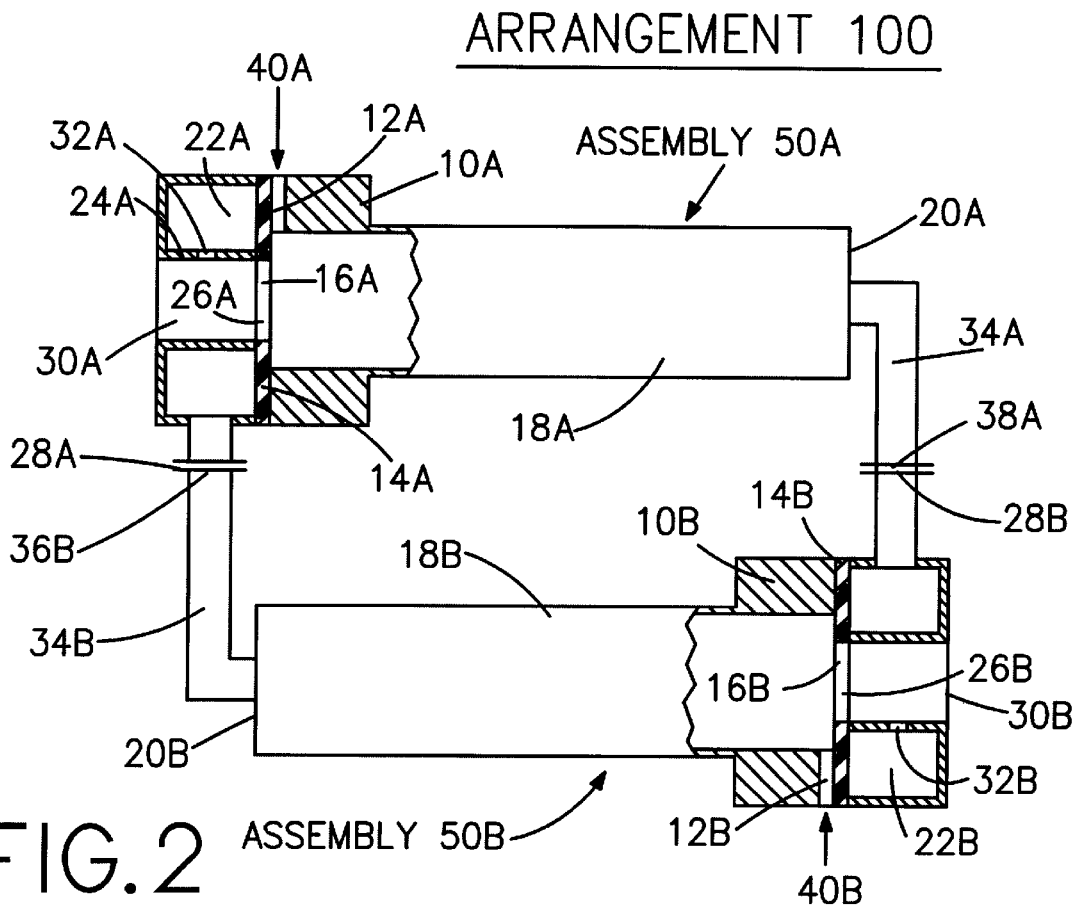
FIG. 2 is a schematic design and flow diagram of another embodiment of the invention.

Another embodiment of the present invention is shown in FIG. 2.

A non-freezing vortex tube arrangement 100 includes two vortex tube assemblies 50A and 50B.

Specifically, assembly 50A includes a vortex tube 10A provided with the inlet nozzle 12A, a diaphragm 14A provided with a central hole 16A, a slender tube 18A with its outlet opening 20A, and a heat exchanger 22A provided with an inner passage 24A, two inlet openings 26A and 28A, one outlet opening 30A and an uncontrolled opening 32A set up on the inner passage 24A. Openings 26A and 30A also serve as inner passage's 24A inlet and outlet, respectively.

Assembly 50B includes a vortex tube 10B provided with the inlet nozzle 12B, a diaphragm 14B provided with a central hole 16B, a slender tube 18B with its outlet opening 20B, and a heat exchanger 22B provided with an inner passage 24B, two inlet openings 26B and 28B, one outlet opening 30B and an uncontrolled opening 32B set up on the inner passage 24B. Openings 26B and 30B also serve as inner passage's 24B inlet and outlet.

A gas flow in the direction of arrow 40A enters assembly 50A through the vortex tube's nozzles 12A and then undergoes an energy (temperature) separation forming a cold and hot fraction.

A cold fraction is discharged from the vortex tube 10A through diaphragm hole 16A and enters into a heat exchanger inlet opening 26A, then goes through inner passage 24A in the heat exchanger and leaves or exit from the heat exchanger 22A through its outlet opening 30A. A hot fraction passes through slender tube's 18A outlet opening 20A and is then directed through line 34A and its outlet 36A and enters into heat exchanger 22B through inlet opening 28B and goes toward the uncontrolled opening 32B simultaneously flowing over the surfaces on the inside of the heat exchanger and leaves or exit from the heat exchanger through uncontrolled opening 32B, mixing up with the cold fraction exiting vortex tube. The uncontrolled opening is preferably located on such side of the passage 30B which is opposite to the heat exchanger inlet 28B; the opening diameter is preferably less than vortex tube's diaphragm diameter.

A gas flow in the direction of arrow 40B enters assembly 50B through the vortex tube's nozzles 12B and then undergoes an energy (temperature) separation forming a cold and hot fraction.

A cold fraction is discharged from the vortex tube 10B through diaphragm hole 16B and enters into a heat exchanger inlet opening 26B, then goes through inner passage 24B in the heat exchanger and leaves or exit from the heat exchanger 22B through its outlet opening 30B. A hot fraction passes through slender tube's 18B outlet opening 20B and is then directed through line 34B and its outlet 36B and enters into heat exchanger 22A through inlet opening 28A and goes toward the uncontrolled opening 32A simultaneously flowing over the surfaces on the inside of the heat exchanger and leaves or exit from the heat exchanger through uncontrolled opening 32A, mixing up with the cold fiction exiting vortex tube. The uncontrolled opening is preferably located on such side of the passage 30A which is opposite to the heat exchanger inlet 28A; the opening diameter is preferably less than vortex tube's diaphragm diameter.

While there has been shown and described what is considered to be the preferred embodiments of the invention, various changes and modifications may be made therein without departing from the scope of the invention.

What is claimed is:

1. A method for a non-freeze enhancement in a vortex tube assembly, said non-freeze enhanced vortex tube assembly includes a heat exchanger having an uncontrolled opening in its inner passage and a vortex tube comprising a slender tube, a diaphragm having a hole in the center thereof and closing one end of the vortex tube, one or more tangential nozzles piercing the slender tube just inside the diaphragm and an outlet opening on the other end of the vortex tube, the method comprises ways of connecting the non-freeze enhanced vortex tube as follows:

a. attaching a heat exchanger to an outward side of a vortex tube's diaphragm;

b. connecting a vortex tube's diaphragm hole for discharging a cold fraction flow with a heat exchanger's inlet opening and then connecting the inlet opening through a heat exchanger's inner passage with a heat exchanger's outlet opening to discharge gas flow from the non-freeze enhanced vortex tube assembly; and c. connecting a vortex tube outlet opening at the far end of the vortex tube with another heat exchanger's inlet opening, thus providing for the hot flow to flow over the surfaces on the inside of the heat exchanger and then leave or exit the heat exchanger through an uncontrolled opening in the heat exchanger's inner passage to mix with the cold fraction exiting the vortex tube.

2. A method for a non-freeze enhancement in a vortex tube arrangement, said non-freeze enhanced vortex tube arrangement includes two heat exchangers each having an uncontrolled opening in its inner passage and two vortex tubes each comprising a slender tube, a diaphragm having a hole in the center thereof and closing one end of each of the vortex tubes, one or more tangential nozzles piercing each slender tube just inside the diaphragm and an outlet opening on the other end of each vortex tube, the method comprises ways of connecting the non-freeze enhanced vortex tube arrangement as follows:

a. attaching a first heat exchanger to an outward side of a first vortex tube's diaphragm, thus forming a first vortex tube assembly;

b. attaching a second heat exchanger to an outward side of a second vortex tube's diaphragm, thus forming a second vortex tube assembly;

c. connecting a first vortex tube's diaphragm hole for discharging a cold faction flow with a first heat exchanger's inlet opening and then connecting the inlet opening through a heat exchanger's inner passage with a heat exchanger's outlet opening to discharge gas flow from the first non-freeze enhanced vortex tube assembly; and d. connecting a second vortex tube's diaphragm hole for discharging a cold fraction flow with a second heat exchanger's inlet opening and then connecting the inlet opening through a heat exchanger's inner passage with a heat exchanger's outlet opening to discharge gas flow from the second non-freeze enhanced vortex tube assembly; and e. connecting a first vortex tube outlet opening at the far end of the vortex tube with another second heat exchanger's inlet opening, thus providing for the hot flow of the first vortex tube to flow over the surfaces on the inside of the second heat exchanger and then leave or exit the heat exchanger through an uncontrolled opening in the second heat exchanger's inner passage to mix with the second vortex tube's cold fraction exiting the vortex tube, and f. connecting a second vortex tube outlet opening at the far end of the vortex tube with another first heat exchanger's inlet opening, thus providing for the hot flow of the second vortex tube to flow over the surfaces on the inside of the first heat exchanger and then leave or exit the heat exchanger through an uncontrolled opening in the first heat exchanger's inner passage to mix with the first vortex tube's cold fraction exiting the vortex tube.

3. The method of claim 1 wherein an uncontrolled opening is preferably located on such side of the heat exchanger inner passage which is opposite to the heat exchanger inlet.

4. The method of claim 2 wherein an uncontrolled opening is preferably located on such side of the heat exchanger inner passage which is opposite to the heat exchanger inlet.

5. The method of claim 1 wherein an uncontrolled opening diameter is preferably less than the vortex tube's diaphragm diameter.

6. The method of claim 2 wherein an uncontrolled opening diameter is preferably less than the vortex tube's diaphragm diameter.

* * * * *